United States Patent [19]

Kimblin

[11] 4,021,628

[45] May 3, 1977

[54] VACUUM FAULT CURRENT LIMITER

[75] Inventor: Clive W. Kimblin, Pittsburgh, Pa.

[73] Assignee: Westinghouse Electric Corporation, Pittsburgh, Pa.

[22] Filed: Jan. 20, 1975

[21] Appl. No.: 542,484

[52] U.S. Cl. ..... 200/144 B; 200/147 R

[51] Int. Cl.[2] ..... H01H 33/66

[58] Field of Search ..... 200/144 B, 148 A, 147 R

[56] References Cited

UNITED STATES PATENTS

| | | | |
|---|---|---|---|
| 1,906,602 | 5/1933 | Hull | 200/144 B |
| 3,147,356 | 9/1964 | Luehring | 200/144 B |
| 3,624,324 | 11/1971 | Barkan et al. | 200/144 B |
| 3,708,638 | 1/1973 | Mitchell | 200/144 B |
| 3,737,819 | 6/1973 | Thuries et al. | 200/148 A |

*Primary Examiner*—Robert S. Macon
*Attorney, Agent, or Firm*—W. G. Sutcliff

[57] ABSTRACT

A vacuum current limiting circuit interrupter having rapidly separable contacts and magnetic field coils disposed to produce a magnetic field transverse to the arc formed during circuit interruption. The transverse magnetic field creates arc instability and causes rapid arc extinction. The relatively movable contacts are disposed in an evacuated insulating envelope and are movable between a closed position completing an electrical circuit through the vacuum interrupter and an open position wherein the contacts are spaced relatively far apart with respect to the necessary voltage withstand level of the circuit interrupter. Magnetic field coils are supported to produce a magnetic field transverse to the arc plasma when the contacts approach maximum separation creating arc instability. An alternate current limiting path is provided in parallel with the vacuum interrupter through which reduced current flows until complete circuit interruption.

9 Claims, 6 Drawing Figures

VACUUM FAULT CURRENT LIMITER

BACKGROUND OF THE INVENTION

1. Field of the Invention

The disclosed invention is related to current limiting devices and more particularly to a current limiting device utilizing a vacuum interrupter providing for a transverse magnetic field to be applied to the arc formed across the relatively movable contacts during circuit interruption.

2. Description of the Prior Art

There is a need in the Electric Power industry for a fast acting switch to be an integral part of a current limiting system. The necessity of the current limiting device is brought about by the increased fault current available in power systems. This necessitates an upgrading of present circuit breakers or installing devices to limit fault current. The various requirements have been discussed thoroughly by C. A. Falcon et al., IEEE Symposium on Current Limiting Devices held at California on July 18, 1974 in a paper entitled "Current Limiting Devices — Need and Application".

Various current limiting devices have been proposed and are under development. In a prior art current limiting device, a vacuum circuit interrupter is opened during the current rise to peak fault current. The arc current is subsequently pulsed to zero by discharging capacitor current in the opposite direction to fault current flow. This opposing current is supplied from a capacitor discharge through a triggered vacuum gap. The vacuum interrupter circuit current then commutates into a current limiting reactor or resistor bank in parallel with the vacuum switch. This system has the disadvantage of requiring two current pulse circuits, one for each arc polarity. A further disadvantage is that the capacitors of the pulse circuit are exposed to the power line potential, and consequently are expensive.

In another prior art current limiting device when fault current is sensed a fast acting $SF_6$ switch is activated. Activating the $SF_6$ switch transfers the current to a cross field tube and when the magnetic field in the tube is relaxed the current commutates in the tube either into a reactor or a resistor bank. Disadvantages of this system are the required three stage current transferring device and the use of the cross field tube which at this time is an experimental tube still undergoing research development.

U.S. Pat. No. 3,283,103 teaches the use of an applied magnetic field to a vacuum interrupter during current interruption to confine the arc plasma to the inner electrode gap. In this device interruption occurs at current zero, not before. There is no suggestion that this device can be used for current limiting.

U.S. Pat. No. 3,716,685 disclosed a magnetic field oriented in direction both parallel to and radially perpendicular to the general direction of the current flow at the instant the circuit is interrupted to create instability in the arc thereby forming to cause the arc to move into contact with surrounding baffles. This patent teaches that the axial magnetic field component be stronger than the radial magnetic field component for the desired arc movement. There is no indication in U.S. Pat. No. 3,716,685 of the desirability of using a transverse magnetic field on a vacuum circuit interrupter utilizing current chopping for current limiting.

U.S. Pat. Nos. 3,564,176 and 2,922,926 disclose an arc extinguishing device utilizing magnetic plates to produce arc instability which facilitates arc extinction. In these patents there is no suggestion the plates can be utilized with current chopping in a vacuum interrupter to provide current limiting.

In proceedings of the IEEE, Volume 60, No. 8, August, 1962; a paper entitled "Pulsed Metallic-Plasma Generators" describes a device which utilizes a vacuum arc as the plasma source. The arc is initiated on the surface of a consumable cathode which can be any electrically conductive material. The plasma is ejected in the form of a high velocity highly directional conical plume through a ring shaped anode. One or more magnetic field coils may be used to control the impedance and direction of the plume. It is suggested in this paper that the generator can be used as a very high power switching device. The pulsed metallic plasma generator utilizes fixed electrodes with a ring shaped anode concentric with a cathode igniter assembly. Problems with this device are that it is sensitive to arc polarity , which can present problems when utilized on an alternating current circuit, and the electrodes of the device are fixed so they cannot close to create a circuit therethrough.

SUMMARY OF THE INVENTION

A current limiting circuit interrupter having a pair of relatively movable contacts disposed within an evacuated enclosure, movable between a closed position completing an electric circuit and an open position forming an arcing gap therebetween across which an arc is formed during circuit interruption, and a magnetic field disposed to produce a magnetic field transverse to the arc formed during circuit interruption. A current limiting impedance can be connected external to and in parallel with the pair of contacts to provide an alternate path when the arc is extinguished. Contacts of the vacuum interrupter can be formed from material having high current chopping characteristics to facilitate extinction or chopping of the arc formed during circuit interruption. Tungsten is one material which exhibits the desired properties. Baffles can be mounted internal of the vacuum envelope containing the interrupter contacts to engage the arc during circuit interruption and enhance arc instability. An axial magnetic field can be disposed to be applied to the vacuum interrupter while the contacts are being separated during circuit interruption. When the axial magnetic field is removed the arc tends to become unstable and this enhances the interruption ability. As the axial magnetic field is removed a transverse magnetic field can be applied causing rapid arc extinction, before a normal AC current zero.

During operation, within the first two milliseconds of fault current rise, the disclosed vacuum interrupter in the high voltage high current line will be activated. The vacuum interrupter contacts separate rapidly to a relatively large separation. Repulsion coils or other appropriate apparatus may be required on or connected to the contact structure for the desired rapid separation. When the contacts are widely separated a transverse magnetic field is pulse-applied to the vacuum arc. This magnetic field which is applied transverse to the initial arc path creates arc instability. The arc then extinguishes and current is transferred to a parallel current limiting device. The parallel current limiting device can be a lightning arrester, resistor, reactor bank, or the like. Arc instability can be further enhanced by the provision of baffles internal to the interrupter and the use of contact materials, such as tungsten, which are associated with high cathode spot mobility.

The desirability of large contact separation on a practical device may necessitate the use of an axial magnetic field in order to postpone anode spot formation during contact separation. Under these circumstances the axial magnetic field will be removed at or near maximum contact separation and this would have a tendency to cause arc instability. Subsequent application of a transverse field would create the desired current zero.

A vacuum interrupter having the transverse magnetic field coils can be connected in series with one or more additional vacuum interrupters. Arcs in the standard vacuum interrupters would extinguish at the same instant as the arc in the current limiting vacuum interrupter utilizing the transverse magnetic field. However, the recovery voltage following forced current zero would be impressed upon the series gaps of all the vacuum interrupters. This would provide for high voltage withstand capability and facilitate operation in a high voltage circuit. In some instances it may also be desirable to connect capacitors in parallel with the interrupter contacts. The capacitors enhance arc instability and also lower the rate of rise of the recovery voltage following arc current zero. Current interruption in the vacuum interrupter can benefit from the use of parallel capacitor. The disclosed vacuum interrupter can be used as a current limiting device on an alternating current circuit or a direct current circuit. It is advantageous to use a vacuum interrupter with its separable contacts, which can carry continuous current of either polarity. This provides a solution to some of the polarity problems encountered in prior art devices. By utilizing the transverse magnetic field to enhance the current chopping characteristics of the selected vacuum interrupter, a fast acting current limiting device can be obtained.

It is an object of this invention to teach a vacuum current limiting circuit interrupter, utilizing a pair of separable contacts across which an arc forms during circuit interruption, and a transverse magnetic field applied to cause arc instability and rapid arc extinction.

It is a further objective of this invention to teach a vacuum interrupter which encourages arc instability and current chopping upon contact separation.

BRIEF DESCRIPTION OF THE DRAWINGS

For a better understanding of the invention, reference may be had to the preferred embodiment exemplary of the invention shown in the accompanying drawings, in which.

DESCRIPTION OF THE PREFERRED EMBODIMENT

Figure 1:
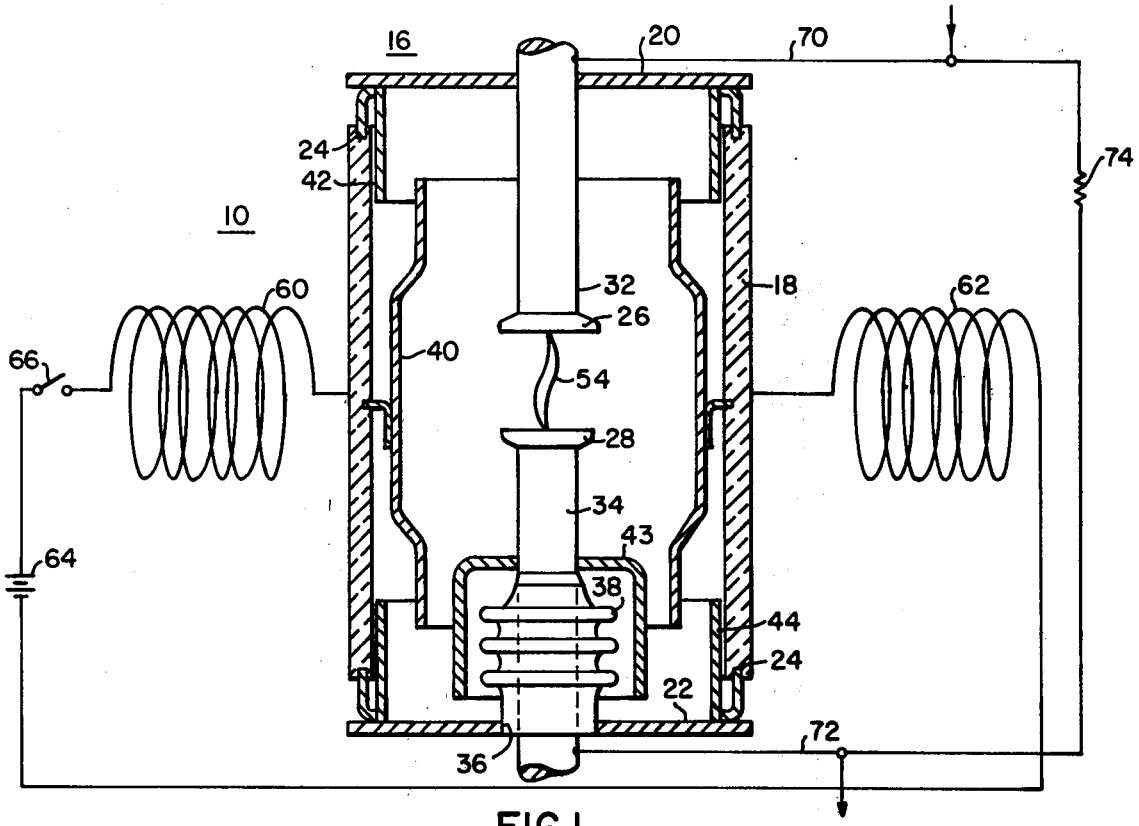
FIG. 1 shows a sectional view of a vacuum type circuit interrupter utilizing teaching of the present invention.

Referring now to the drawings and FIG. 1 in particular there is shown a vacuum type circuit interrupter 10 utilizing the teaching of the present invention. The vacuum current limiting circuit interrupter 10 utilizes a vacuum interrupter 16 which comprises a highly actuated tubular envelope 18 formed from glass or suitable ceramic material and a pair of metallic end caps 20 and 22 sealing off the ends of the insulating envelope 18. Suitable seals 24 are provided between the end caps 20 and 22 and the insulating envelope 18, to insure the inside of the insulating envelope 18 is vacuum tight. The pressure in the envelope 18 under normal operating conditions is lower than $10^{-4}$ torr to insure that the mean free path for electron travel will be longer than the potential breakdown path within the envelope 18. Located within the insulating envelope 18 are a pair of relatively movable electrodes or contacts 26 and 28. When the contacts 26 and 28 are separated there is formed an arcing gap therebetween. During circuit interruption an arc 54 can form between the separated contacts 26 and 28. The upper contact 26 is a stationary contact secured to a conducting rod 32 by a suitable means such as welding or brazing. The conducting rod 32 is rigidly joined to the stationary end cap 20 by a suitable connection such as welding or brazing. The lower contact 28 is a movable contact and is joined to a conductive operating rod 34 by suitable means such as welding or brazing. The operating rod 34 is suitably mounted for movement along the longitudinal axis of the insulating envelope 18. The operating rod 34 projects through an opening 36 in end cap 22 as shown in FIG. 1. A metal bellows 38 is secured in sealing relationship at its respective opposite ends to the operating rod 34 and to the bellows end cap 22. The flexible metallic bellows 38 provides a seal with the operating rods 34 to allow for movement of the operating rods 34 without impairing the vacuum within the envelope 18. Coupled to the low end of the operating rod 34 is a suitable actuating means for driving the movable contact 28 upward into engagement with the stationary contact 26 so as to close the interrupter 16. The actuating means should be capable of moving the contacts to a relatively large separation such as 2 centimeters within a short period of time such as 1 millisecond. When the contacts 26 and 28 are separated during circuit interruptions an arc 54 is formed in the arcing gap between contacts 26 and 28. The arc 54 which is formed between the contacts 26 and 28 melts and vaporizes some of the contact material. These vapors and particles are disbursed from the arcing gap toward the insulating envelope 18. The inner insulating surfaces of the insulating envelope 18 are protected from the condensation of arc generated metallic vapors and particles by means of a tubular metallic shield 40 which is suitably supported on the insulating envelope 18 and preferbly electrically isolated from both end caps 20 and 22. This shield 40 acts to intercept and condense arc generated metallic vapors and particles before they can reach the insulated envelope 18. To further reduce the chance for vapor or particles reaching the insulating envelope 18 by bypassing the shield 40 a pair of end shields 42 and 44 are provided on opposite ends of the main central shield 40. A cup shaped shield 43 is attached to the movable operating rod 34 and partially surrounds metallic bellows 38 to prevent bellows 38 from being bombarded by arc generated metallic vapors or particles. The speed with which the vapors generated during arcing are removed determines the recovery capability of the unit. If the vapor is not quickly removed high voltage transients might cause the arc to reignite after it has been extinguished resulting in failure of the interrupter 16.

Field coils 60 and 62 are disposed to produce a transverse magnetic field across the arc 54, when activated. The relatively long arc 54 is established in vacuum interrupter 16 and is rendered unstable by a pulsed magnetic field from field coils 60 and 62 transverse to the approximate arc longitudinal axis. The transverse magnetic field creates an arc current zero prior to normal current commutation at a normal alternating current zero. A power supply 64 is provided for energizing field coils 60 and 62 when switch 66 is closed. Since field coils 60 and 62 can be energized from a supply isolated from line voltage, they can be at any desired potential. This provides safety advantages and permits low cost low voltage capacitors to be used for the power supply. During normal operation when contacts 26 and 28 are closed a current path is completed from line 70 to line 72 through vacuum interrupter 16. When contacts 26 and 28 are open and arc 54 is extinguished, current is caused to flow through resistor 74. The strong magnetic field transverse to the vacuum arc 54 forces the arc 54 to zero. The high transverse field creates arc instability by impeding current flow between contacts 26 and 28 and by driving the cathode spot off the cathode with resulting vapor and plasma starvation in the anode regions. When this strong transverse magnetic field is combined with a rapid contact separation to a relatively large spacing, a current limiting circuit interrupter can be constructed. Current interruption is accomplished within the first 2 milliseconds of the fault current rise as vacuum interrupter 16 is opened. Vacuum interrupter 16 is opened to a relatively large contact separation, for example 2 centimeters, and this should be accomplished relatively fast and might require repulsion coils on the contacts 26 and 28 or contact support 32 and 34. It is to be understood while FIG. 1 shows only contact 28 as being movable, both contacts 26 and 28 can be movable with respect to enclosure 18 to permit more rapid separation. With the contacts 26 and 28 widely separated and an arc formed therebetween as shown in FIG. 1 a magnetic field is pulse-applied to the vacuum arc 54. This magnetic field supplied by coils 60 and 62 is applied transverse to the initial arc path and creates arc instability. The arc 54 then snaps out and the current is transferred to a parallel current limiting device 74. Device 74 can be a lightning arrester, conventional resistors, reactor bank, or the like. Arc instability can be enhanced by constructing contacts 26 and 28 of materials, such as tungsten, which are associated with high cathode spot mobility and high current chopping levels. The vacuum interrupter 16 since it creates a current zero can be used as a direct current interrupter.

Figure 2:
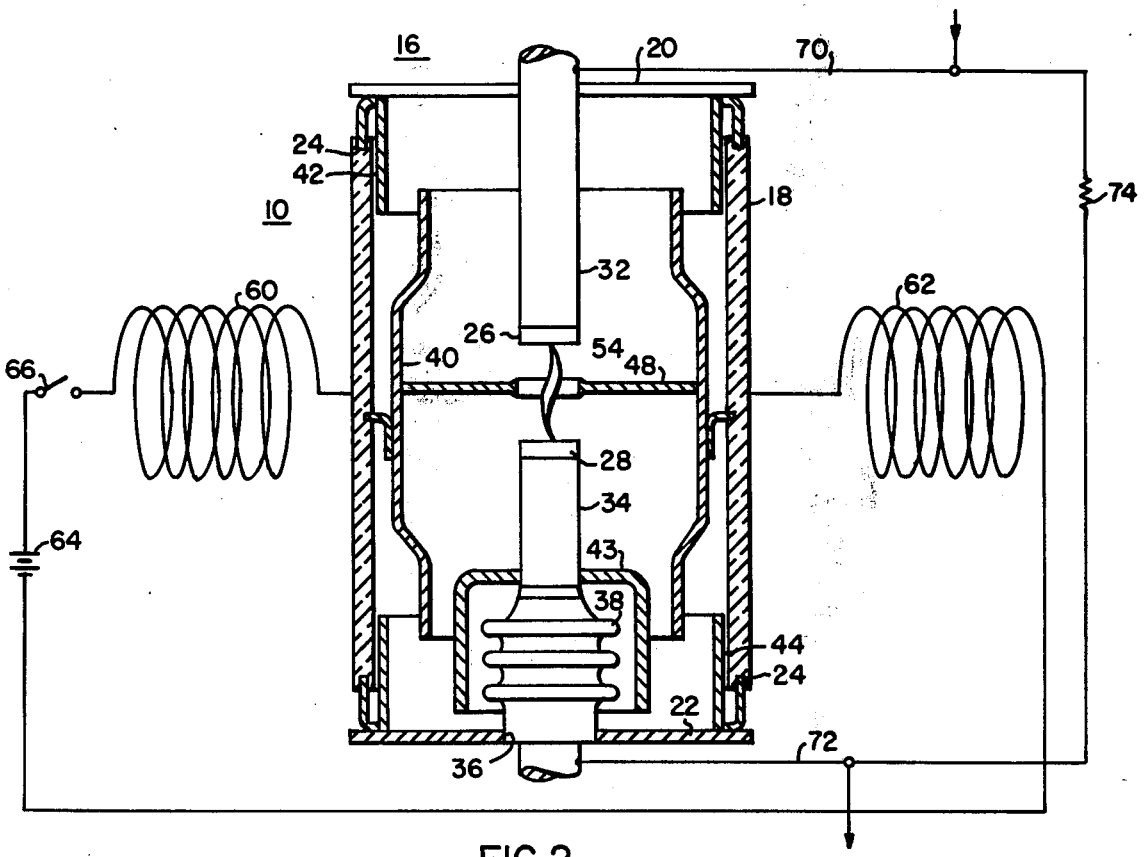
FIG. 2 shows a vacuum type circuit interrupter similar to FIG. 1 utilizing baffles for increased arc instability.

Referring now to FIG. 2 there is shown a vacuum current limiting circuit interrupter 10 wherein the vacuum interrupter 16 is provided with a baffle 48 internal of vacuum interrupter 16. The baffle 48 disposed near the arcing gap between contacts 26 and 28 can be of any suitable materials such as metal or ceramic. The baffle 48 disposed within vacuum interrupter 16 enhances instability of arc 54.

The desirability of a long separation of contacts 26 and 28 may necessitate the use of an axial magnetic field in order to postpone anode spot formation until the contacts are fully separated. Under these circumstances the axial magnetic field would be removed at maximum contact 26, 28 separation and this would have a tendency to create arc instability. As the axial magnetic field is removed coils 60 and 62 would be energized applying a magnetic field transverse to the arc 54. Sequential application of the transverse magnetic field would create the desired current zero.

Figure 3:
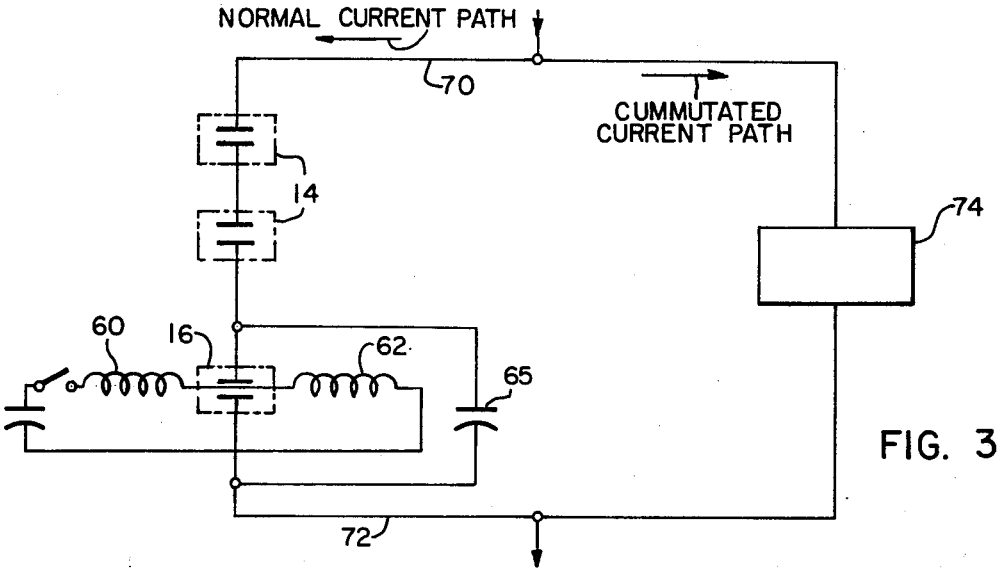
FIG. 3 shows a high voltage current limiting circuit interrupter utilizing a current limiting vacuum interrupter, with a transverse magnetic field, in series with additional vacuum interrupters.

Referring now to FIG. 3 there is known a vacuum interrupter 16, to which a transverse magnetic field can be applied during circuit interruption, connected in series with one or more standard vacuum interrupters 14. Arc extinction in vacuum interrupter 16 can be accomplished as described above upon application of the transverse magnetic field. Arcs formed in vacuum interrupters 14 would extinguish at the same instance as the arc 54 when the transverse magnetic field is applied to interrupter 16. However, recovery voltage following forced current zero would be impressed across the many series gaps of interrupters 14 an 16. This arrangement is desirable for a high voltage current limiting system. As the current flowing through vacuum interrupters 14 and 16 is suppressed the current path would be transferred through parallel current limiting device 74.

Figure 6:
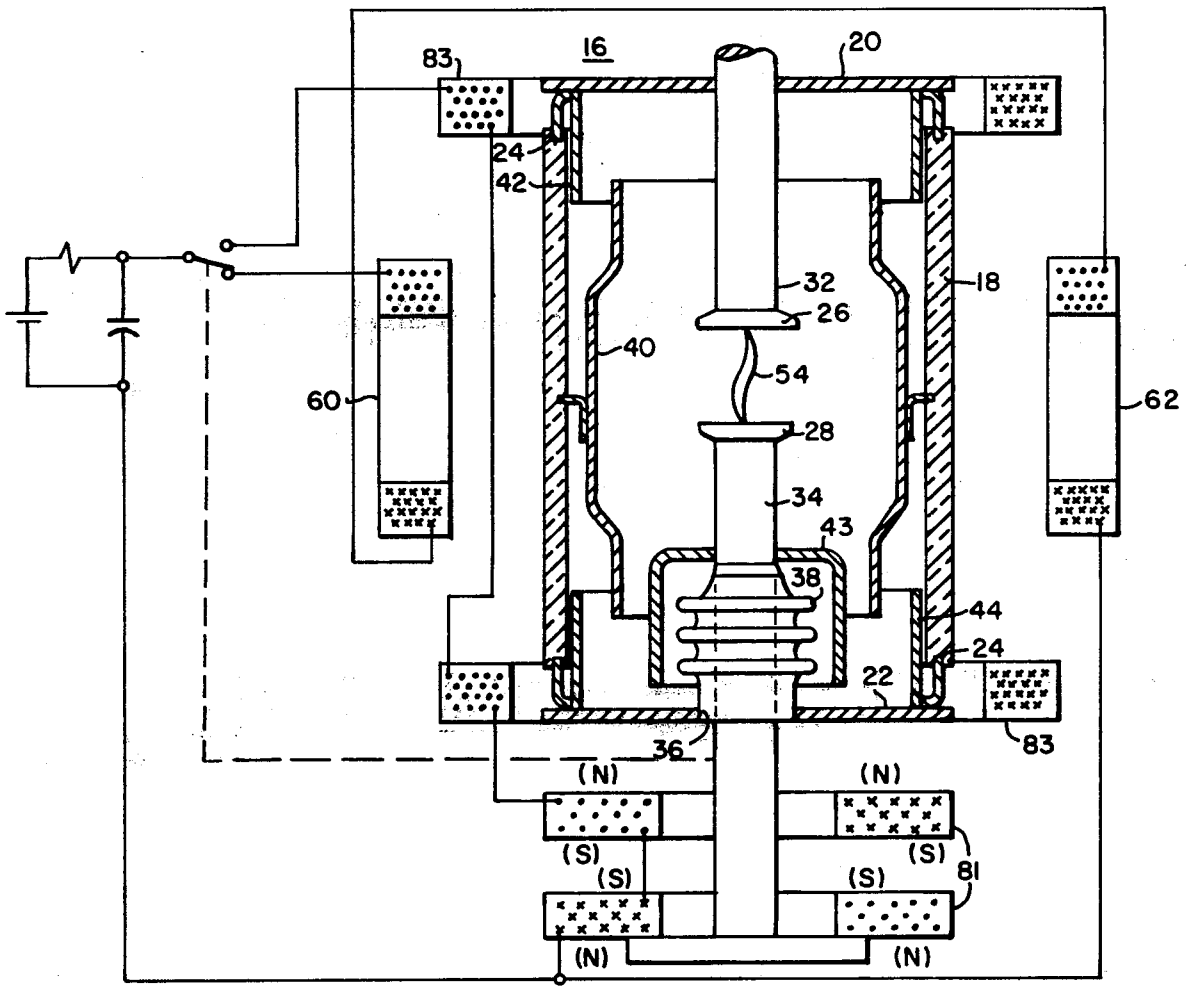

Referring now to FIG. 6, there is shown a current limiting vacuum interrupter utilizing repulsion coils 81 and axial magnetic field coils 83. As shown in FIG. 6, the repulsion coils 81 and axial field coils 83 can be connected in series, if desired. Also, as shown, the power supply can be switched from the axial coils 83 to the transverse coils 60 and 62 a vacuum interrupter 16 is opened. This can be accomplished by a switch which is activated by the movable operating rod 34. Also, the current flow through the various coils 60, 62, 81, or 83 can be derived from circuit current if desired. During opening of vacuum interrupter 16 shown in FIG. 6, current is passed through repulsion coils 81 so that opposing magnetic fields are created and coils 81 are rapidly forced apart. This quickly opens vacuum interrupter 16. A latch can be provided for latching contact 28 in the open position after the contacts 26 and 28 are forced apart.

Capacitor 65 can be connected in parallel with the arcing contacts 26 and 28. These capacitors 65 enhance arc instability and also lower the rate of rise of restored voltage following arc current zero. Forced interruption in vacuum interrupter 16 will benefit from the use of parallel capacitance. For example, with contact interruption of a current peak of 1.65 KA arc in a 60 Hz circuit, a 14 microfarad capacity in parallel with the interrupter aided the interruption and limited the overvoltage to 33 KV.

Figure 4:
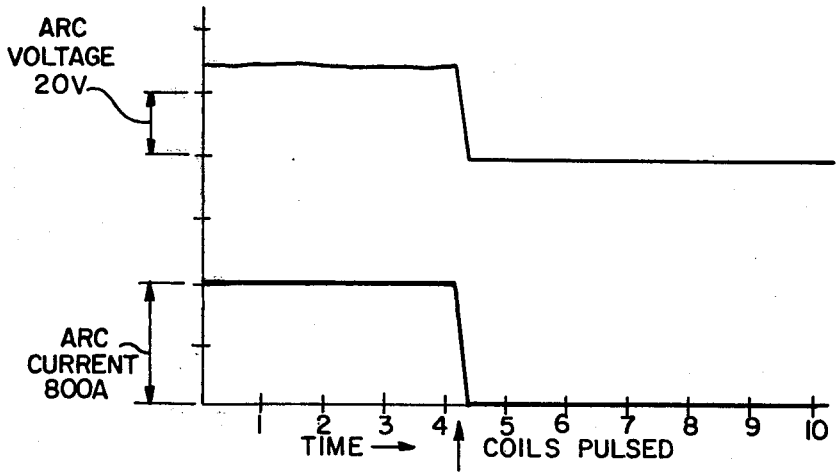
FIG. 4 is a graphic representation of a transverse pulsed magnetic field applied to a vacuum interrupter to extinguish an AC arc.

Experimental verifications have shown the feasibility of utilizing transverse magnetic fields for current limiting. In a recent experiment a standard 3-inch diameter interrupter was mounted between two coils disposed to produce a transverse magnetic field. Each of these coils was 6 inches in diameter and comprised 50 turns of wire. Coils were then energized and the behavior of the arc current and the arc voltage was monitored. As can be seen from FIG. 4 when a pulsed magnetic field is applied by the coils at current peak rapid arc instability and arc extinction occur.

Figure 5:
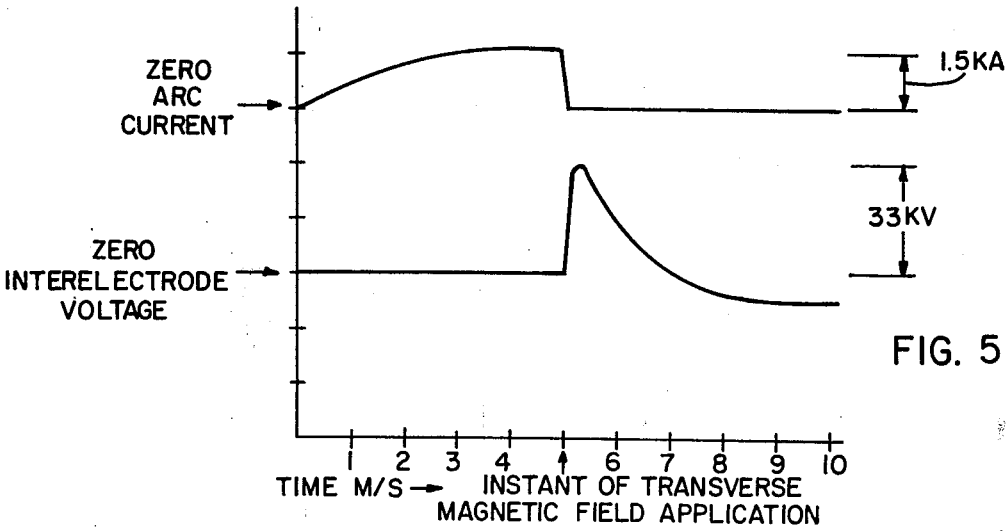
FIG. 5 is a graphic representation of DC arc current and DC arc voltage interruption as a transverse magnetic field is applied to a vacuum interrupter; and, FIG. 6 shows a vacuum type circuit similar to FIG. 1 but including repulsion coils and axial magnetic field coils.

FIG. 5 shows the effect of a pulsed magnetic field on an 800 amp D.C. arc burning at a contact spacing of ½ inch with a charged capacitor discharged through transverse field coils. It can be seen that the arc current interruption is almost instantaneous with field application. Test runs at higher currents have demonstrated that the arc currents can be forced to zero in less than 1 millisecond of field application. These demonstrtions of forced current zero indicate that a vacuum interrupter exposed to a transverse field may play a significant part in a current limiting system. Larger contact separation and higher pulse fields will promote arc instability at current levels of several thousand amperes in high voltage circuits.

I claim:

1. A fast acting current limiting vacuum device which is operable to limit high voltage, high current line faults comprising:

an insulated evacuated enclosure;

a pair of contacts disposed within said insulating evacuating enclosure, movable between a closed position completing an electric connection path through the enclosure and an open position wherein the contacts are spaced apart forming an arcing gap therebetween across which an arc is formed;

means for rapidly separating the pair of contacts to a spacing sufficient to permit an applied transverse magnetic field to produce an arc current zero and to prevent restriking of the arc across the separated contacts;

impedance means connected external to the enclosure in parallel across the contacts whereby the shunted fault current can be limited;

magnetic field means disposed to produce a magnetic field transverse to the arc formed between the separated contacts, which transverse magnetic field is generated after the contacts are separated a distance which permits the arc between the contacts to be rapidly extinguished, and which magnetic field rapidly increases the potential across the contacts to cause the fault current to be shunted to the parallel current limiting impedance path.

2. The current limiting vacuum device specified in claim 1, wherein the impedance means includes a capacitive element to aid current commutation from the arc and to reduce the rate of rise of restored voltage across the separated electrodes.

3. The current limiting vacuum device specified in claim 1, wherein for connection to an alternating current line the magnetic field means produces a transverse magnetic field sufficient to produce an arc current zero during the fault current rise and in a time less than the period of a half cycle of line voltage oscillation.

4. The current limiting vacuum device specified in claim 1, wherein the means for rapidly separating the contacts achieves a separation of about 2 centimeters in about 1 millisecond.

5. The current limiting vacuum device specified in claim 1, wherein the transverse magnetic field is generated after the contacts are separated by about 2 centimeters.

6. The current limiting vacuum device specified in claim 1, wherein the contacts are formed of a material which has high current chopping properties.

7. The current limiting vacuum device specified in claim 6, wherein the contact material is tungsten.

8. The current limiting vacuum device specified in claim 1, wherein baffle means are disposed within the insulating envelope between the contacts to restrict the arc path during circuit operation.

9. The current limiting vacuum device specified in claim 1, wherein axial magnetic field means apply an axial magnetic field along the arc direction between the contacts during contact separation, which axial magnetic field means is inoperative when the transverse magnetic field means are actuated.

* * * * *